United States Patent [19]

Fernández Jiménez de Castro

[11] Patent Number: 5,052,691

[45] Date of Patent: Oct. 1, 1991

[54] GAME OF ENTERTAINMENT

[76] Inventor: José L. Fernández Jiménez de Castro, Plaza de los Descalzos, No. 4, 45600 Talavera de la Reina (TOLEDO), Spain

[21] Appl. No.: 582,502

[22] Filed: Sep. 13, 1990

[30] Foreign Application Priority Data

Sep. 19, 1989 [ES] Spain ..... 8903163

[51] Int. Cl.[5] ..... A63F 3/00

[52] U.S. Cl. ..... 273/241; 273/284

[58] Field of Search ..... 273/236, 241,.242, 271, 273/272, 280, 284

[56] References Cited

U.S. PATENT DOCUMENTS

| | | | |
|---|---|---|---|
| 3,152,806 | 10/1964 | Jackman | 273/284 X |
| 3,359,003 | 12/1967 | Kass | 273/241 |
| 3,386,739 | 6/1968 | Lino | 273/284 X |
| 3,804,418 | 4/1974 | Sander | 273/284 |
| 4,437,667 | 3/1984 | Miller | 273/241 X |
| 4,468,036 | 8/1984 | Istrati et al. | 273/271 |

FOREIGN PATENT DOCUMENTS

| | | | |
|---|---|---|---|
| 856857 | 8/1940 | France | 273/284 |
| 931886 | 3/1948 | France | 273/284 |

*Primary Examiner*—Edward M. Coven
*Assistant Examiner*—William E. Stoll
*Attorney, Agent, or Firm*—Toren, McGeady & Associates

[57] ABSTRACT

This game incorporates a quadrangular-prismatic body (1) on which a plurality of quadrangular pieces (3) are set up according to an orthogonal reticle, connected to one another by a tongue and groove joint, so that these pieces can move on any of the two axis of the game platform along annular line ups forming two perpendicular groups, the body (1) and the annular line ups set up around it, being conveniently held in the cavity of a framework, which comprises four lateral deposits (8) which collect chips placed on pieces (3) when these pieces are moved by operating push buttons (10) placed on the front of each of its own deposits (8).

6 Claims, 2 Drawing Sheets

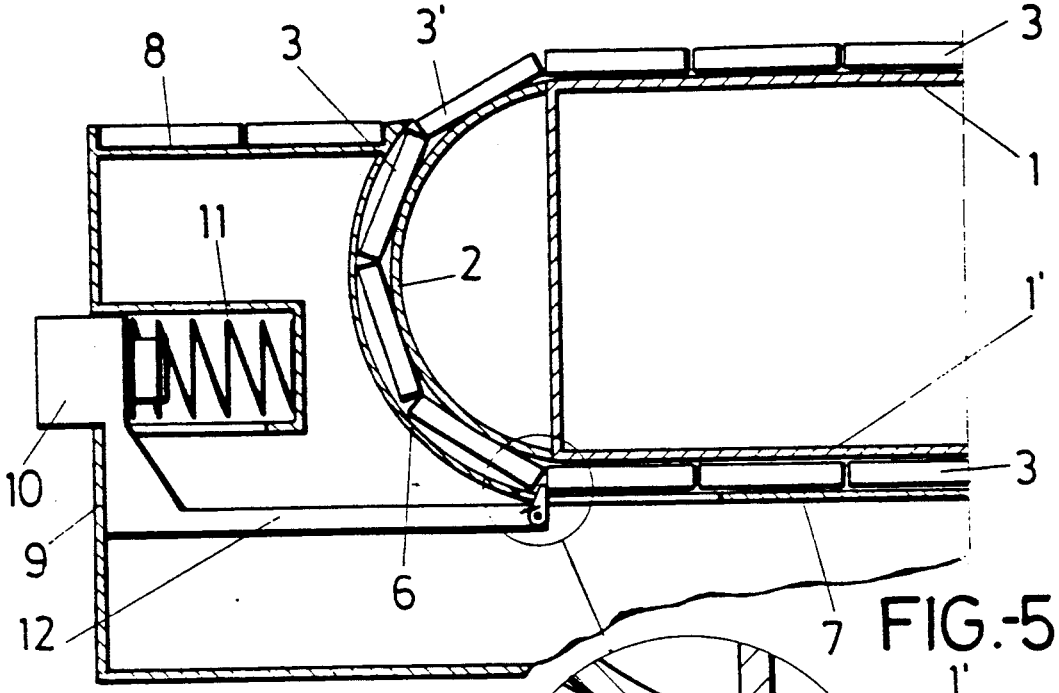
FIG.-5
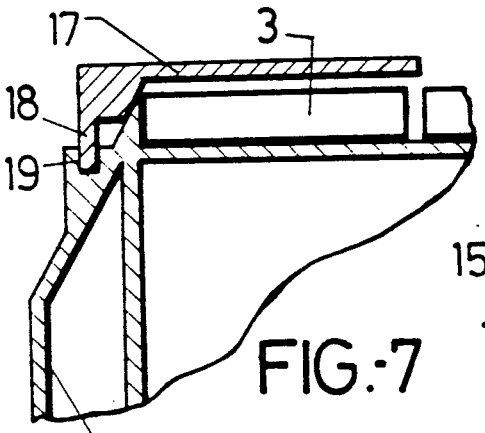
FIG.-7
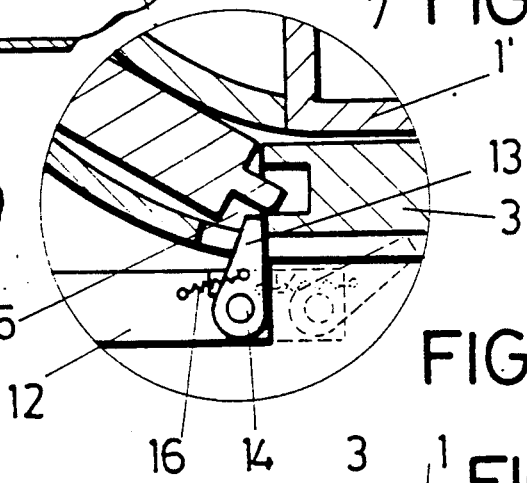
FIG.-6
FIG.-8
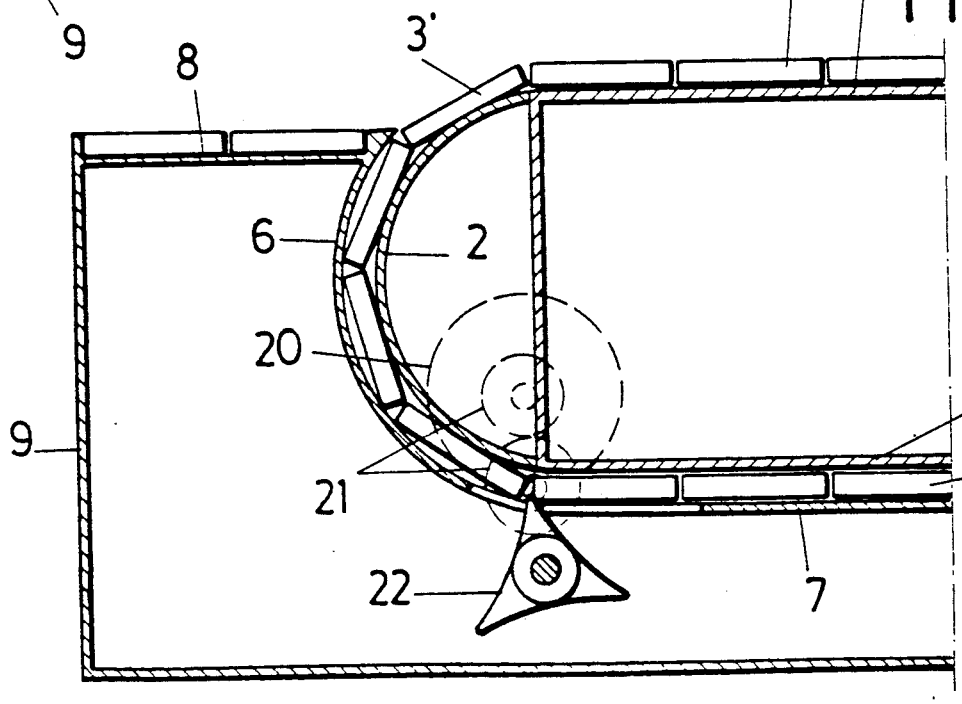

GAME OF ENTERTAINMENT

OBJECT OF THE INVENTION

This invention refers to a game of entertainment, in particular to a game in which a plurality of movable pieces are incorporated, distributed according to an orthogonal reticle and susceptible to move on any of the axis of the level in which they are included.

BACKGROUND OF THE INVENTION

Entertainment games in which the type of pieces above mentioned are incorporated are well known. Flat pieces with a quadrangular outline, having two grooves on two of its edges and two nerves on the others, so that these nerves and grooves establish a tongue and groove joint among the pieces which allows the relative movement on the general level where they are included, as well as acting as a bond of union which does not allow its possible uncoupling.

However, all these well known type of games are based in the establishment of a rectangular game surface, with a perimetric frame that closes it completely holding in majority the described moving pieces with the exception of an area equivalent to the dimensions of one of said pieces, so that this empty space allows the mobility of the same in order that, from an arbitrary or aleatory situation, a particular order is established among said pieces.

This type of game, besides its own limitations as far as the possibility to develop game rules, can only be used by one player at a time.

DESCRIPTION OF THE INVENTION

The entertainment game that the invention proposes, although based on the aforementioned type of moving pieces differs substantially from any game already known and allows four players to participate, and establishes a true competition among them, but the number of players may also be three, two or even one.

For this, in a more concrete way, the classic platform for the moving pieces materializes in a considerably thick body, which can be hollow, basically a prismatic-quadrangular shape, but with the peculiarity that its edges or lateral walls adopt a semicylindrical shape, having the moving pieces not only on the upper and square base of this body but also on its semicylindrical lateral walls and on its bottom base, so that said pieces form a plurality of annular line ups, in other words, closed on themselves, set up according to two perpendicular groups, so that on each line up the working on a particular piece assumes the movement of all the pieces that participate in said annular line up.

As a complement of the described structure and in correspondence with each one of the sides of this prismatic body, a lateral deposit is established; therefore four lateral deposits exist corresponding to the four walls of the body and to the four players that participate in the game.

The upper base of the prismatic body forms the true platform of the game and the lateral deposits are at a substantial lower level regarding said platform of the game, so that with the collaboration of several groups of chips, belonging to each player, which are placed conveninetly on the moving pieces of the upper platform, each player tends to move his/her chips towards his/her corresponding deposit, by moving the annular line ups of pieces that are perpendicular to his/her own deposit, into which said chips fall when they reach the ramp that defines the beginning of the semicylindrical sectors coresponding to the lateral walls or edges of the prismatic body.

Inside these lateral deposits the chips can simply be stored or entered without any order or in addition if needed they can be placed orderly, for which in each of these lateral deposits there is also a pair of longitudinal and annular lines ups alike the initial body.

For the working of the moving pieces each player will have a line up of push buttons in front os his/her deposit, that when pushed they act on the respective annular line ups of moving pieces, provoking them to advance a space equivalent to the length of one of said pieces. Each push button can act on the corresponding annular line up of pieces through the interstices existing between two adjacent ones. The button acts against a spring and in collaboration with a retractile trigger that cancels the motive effect of the push button during its recovery. Each deposit is provided with a lateral or end pulley wheel for the working of its own line up of moving pieces, being able to transversally move the pieces on the platform of the game that are on the parallel line up and near such deposit, while the rest, as mentioned before, can only be moved in perpendicular direction towards the deposit.

For use in accordance with the game rules, caps have been provided to cover the four vertex, to stop the movement of these last transversal rows, so that the two end push buttons of each player are theoretically cancelled and therefore stop the other three players to intervene when the chips are on the last row and only allow, if the player wants or needs to, the player that is in front with his/her chips on the last row to intervene.

Finally, the collaboration of an opaque panel with legs has been provided, that placed on the platform of the game hides it, with the exception of the last two rows of each player, in other words, legs would be placed on the four ends of the four caps mentioned earlier, without interfering in the movement of the pieces, so that when said panel is being used there is no visual control over the chips and it is necessary to memorize the own movements as well as the rest of the player's or just leave the results at random.

DESCRIPTION OF THE DRAWINGS

The following description of the preferred embodiment will be made with reference to the attached drawings, in which:

FIG. 5. Shows a detail of the game, in cross section, at the level of the pulling mechanism of one of the annular line ups of moving pieces..

FIG. 6. Shows a blow up in detail of FIG. 5.

FIG. 7. Shows a detail in section at the level of one of the caps in FIG. 3.

FIG. 8. Finally, this figure shows a transversal section alike FIG. 5, but at a level of any of the four marginal line ups of the moving pieces.

PREFERRED EMBODIMENT OF THE INVENTION

Figure 2:
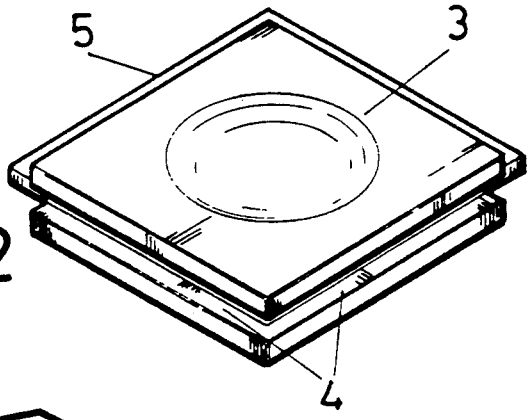
FIG. 2. Gives a detail in perspective, at a larger scale, of one of the moving pieces that participate in the game.

The game of entertainment is structured based on a body (1) with a prismatic-quadrangular shape, with its edges or lateral walls (2) curved semicylindrically, defining a quadrangular platform, over which a plurality of pieces (3) are placed, also quadrangular, of small size, provided on two of its edges with a groove (4) and on the other two with nerves (5) to form tongue and groove joints among them, making a relative movement possible. These pieces (3) form a plurality of adjacent line ups that close themselves in two perpendicular directions around the semicylindrical edges (2); to this purpose the height or thickness of the body (1) must be calculated to allow the pieces (3) to adapt to the semicylindrical edges and to keep the relationship among them, as shown in FIGS. 5 and 8. In these areas the inversion of these pieces is helped by outter walls (6), that hold them laterally, as also can be observed in said figures, and by another horizontal and lower wall (7), parallel and near the bottom base (1')of the body (1), which does not allow the fall of the pieces (3) by gravity in this area.

The lateral and curved protection walls (6) extend to the outter part to form respective lateral deposits (8), one for each edge of the body; these lateral deposits (8) being a part of the outter cover (9) that completes the game not only laterally but also on the bottom.

A plurality of push buttons (10) are set up in front of each lateral deposit (8), as many as annular line ups of pieces (3) lay perpendicular to said deposit (8). These push buttons, together with respective arms (12), act against the tension of respective springs (11), upon the corresponding annular line up pieces (3), causing it to advance towards the player a space equivalent to the length of one piece.

A trigger (13) is joined (14) to the arm (12) and through its free end it is susceptible to be placed in the space (15) defined between two adjacent pieces (3), causing a push on the correspondent line up and an advance of same equivalence to the width of one of such pieces (3). The push button (10) recovers by the spring effect (11), and the trigger (13) scales against another little spring (16) slipping on the adjacent piece (3), as it has been represented in the discontinuous line on FIG. 6, until reaching the suitable position to push this piece as soon as push button (10) is pushed again.

According to this structure, the game offers the possibility for four players to participate simultaneously, with a game platform on which, following the example of the preferred embodiment represented in the drawings, one hundred and fourty four operative reticles are set up, that means 12×12 pieces (3), on which different colour chips are conveniently set up for each player, except on the last row which means that one hundred chips are placed. The last row is left free for the freedom of movement. Each chip moves together with the movement of the piece (3) on which it is placed, until reaching one of the marginal areas of the platform, where said piece (3' in FIG. 5) takes a slanted arrangement that determines the fall by gravity of the chip placed over it, towards the correspondent lateral deposit (8). Each player will tend to move by means of the push buttons (10) his/her own chips towards his/her own deposit. The player will also be able to change, if convenient, the direction of the other players'chips, concious or unconciously.

Figure 1:
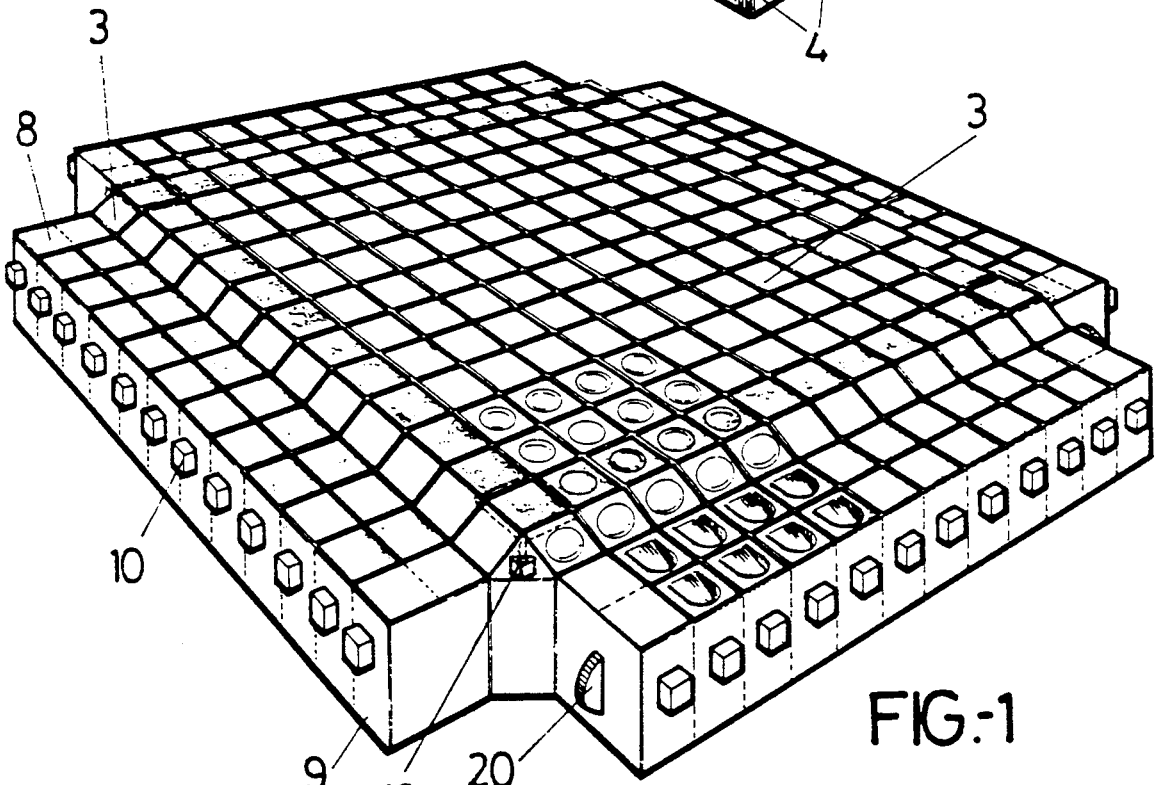
FIG. 1. Gives a general view in perspective of the game of entertainment being the object of this invention.
Figure 3:
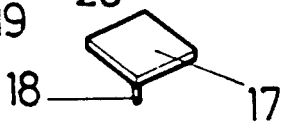
FIG. 3. Gives a view in perspective of one of the caps that cancel the movement of the two end push buttons of each player with regards to the moving pieces of the vertex of the platform of the game.

By choice, the marginal line ups of moving pieces (3), the ones shadowed in FIG. 1, can be blocked or immobilized in longitudinal direction, for which four blocking caps (17) have been provided, to fit on the upper part of a piece (3), as shown on FIG. 7; each one of these caps having on one of its vertex a lower arm (18) which can be introduced in a corresponding hole (19) provided in the game's cover (9). As said cap (17) is immobilized regarding the cover, it immobilizes as well the piece (3) situated in its cavity and this avoids the movements of the two annular line ups affected by said immobilized piece (3).

Figure 4:
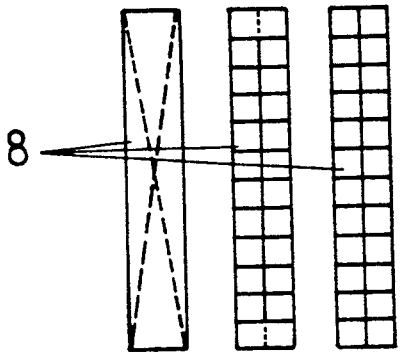
FIG. 4. It schematicly shows three of the possible embodiments of the lateral deposits for collection of the chips.

The lateral deposits (8), used as chip colectors, may have different shapes, as it has been represented in FIG. 4. It can be a simple rectangle where the chips gather with no order; it can be mobile so that each of the chips to be gathered has a concrete position of each pair of chips has a concrete position.

If it happens that the chips have a concrete position, in which case the blocking caps (17) will not be able to be used, each player can also move the transversal line up nearest to such deposit, besides being able to mobilize the line ups of pieces (3) running perpendicularly to the deposit. In order to move this transversal line up a polley wheel (20) has been provided, which acts through an adequate transmission (21) on a pinion (22), able to act in turn on the aforementioned transversal line up.

As already said, the game allows two, three or four players to participate following a very large range of possible game rules, which are not the object of this invention. As mentioned earlier an opaque panel that will be fixed to the connection (19) on the cover (9) can also be used, in order to hide the platform, with the exception of each player's last row, which remains visible; this lack of visibility forces the players to memorize where the chips are placed, so increasing the difficulty.

It is obvious that many alterations may be introduced in the board we have described without exceeding the scope of the claims. For example it may be operated electronically or by computer.

I claim:

1. A game of entertainment characterized in that it comprises a basically prismatic-quadrangular, substantially flat body, whose lateral walls take a curved-convex shape (2), which defines a quadrangular upper platform (1) in which a plurality of little quadrangular pieces (3) are established, distributed according an orthogonal reticle that occupies the whole platform, these pieces being connected to one another by a tongue and groove joint, formed by nerves (5) on two of the edges of each piece and grooves (4) on the other two, with the special pecularity that said sliding pieces (3) also extend around the semicylindrical faces (2) and along the bottom base of the body, so forming a series of annular lines ups, close on themselves, that cross perpendicularly, said prismatic-quadrangular body (1) being housed in a framework (9) whose four lateral walls extend outwardly in respective deposits (8), at a level slightly lower than the one of the upper platform of the body, these deposits being able to collect a plurality of chips which may be placed on the moving pieces (3) of the game platform, and transported by said pieces until falling by gravity into the lateral deposits (8), due to the slanted level that defines the moving pieces when they reach the initial sector of the semicylindrical lateral walls (2).

2. The game of entertainment according to claim 1 characterized in that the inner wall (10) of each lateral deposit (8), is curved inwards to match the path of the moving pieces towards the lower base of the prismatic body, where they are held by a double bottom.

3. The game of entertainment according to claims 1 or 2 characterized in that on the outer walls of each lateral deposit, a plurality of push buttons (10), coincident in number and position with the line ups of moving pieces running perpendicular to it, are established.

4. The game of entertainment, according to claim 3, characterized in that each push button (10) extends in an arm (12) whose end comprises a trigger (13) which slides, when the button is operated against the action of a spring (11), into the slot (15) formed between two adjacent moving pieces, and pushes one of them causing the whole line up of moving pieces to advance.

5. The game of entertainment according to claims 1, 2, or 4; and characterized in that on one of the ends of each lateral deposit, a polley wheel (20) is established, which, through an adequate transmission an a pinion (22) allows a transversal movement of the annular line up of moving pieces running parallel and next to said lateral deposit.

6. Game of entertainment according to the previous claims, characterized in that it incorporates four blocking caps (17) that may be connected to the corners (19) of the platform (1) in a way that they cover the moving pieces (3) located at said corners and immobilize the four annular line ups of moving pieces (3) running parallel and next to the deposits (8) although they do not block their transversal movement.

* * * * *